US005165878A

United States Patent [19]

Inagaki et al.

[11] Patent Number: 5,165,878

[45] Date of Patent: Nov. 24, 1992

[54] SCROLL TYPE COMPRESSOR WITH SLIDE GUIDE FOR PREVENTING ROTATION OF THE MOVEABLE SCROLL

[75] Inventors: Mitsuo Inagaki; Hideaki Sasaya, both of Okazaki; Akikazu Kojima, Gamagoori, all of Japan

[73] Assignee: Nippon Soken, Inc, Nishio, Japan

[21] Appl. No.: 725,450

[22] Filed: Jul. 3, 1991

Related U.S. Application Data

[62] Division of Ser. No. 477,463, Feb. 9, 1990, abandoned.

[30] Foreign Application Priority Data

Feb. 10, 1989 [JP] Japan ..... 1-31727
Feb. 20, 1989 [JP] Japan ..... 1-39751

[51] Int. Cl.[5] ..... F04C 18/04
[52] U.S. Cl. ..... 418/55.3
[58] Field of Search ..... 418/55.3

[56] References Cited

U.S. PATENT DOCUMENTS 801,182 10/1905 Creux ..... 418/55.3
2,841,089 7/1958 Jones ..... 418/55.3
4,259,043 3/1981 Hidden et al. ..... 418/55.3
4,526,521 7/1985 Sudbeck et al. ..... 418/55.3
4,609,334 9/1986 Muir et al. ..... 418/55.3

FOREIGN PATENT DOCUMENTS 55-40220 3/1980 Japan ..... 418/55.3
55-155916 4/1980 Japan .
59-39987 3/1984 Japan ..... 418/55.3
60-175793 9/1985 Japan ..... 418/55.3

*Primary Examiner*—John J. Vrablik
*Attorney, Agent, or Firm*—Cushman, Darby & Cushman

[57] ABSTRACT

A multiple-turn scroll compressor has a first scroll member and a second scroll member. Each of the scroll members has a scroll blade which is engaged with the other. A shaft has an eccentric portion which supports the first scroll member. A cylindrical guide is provided rotatably on a housing and has a guide groove at one end. A slider fixed on the first scroll member engages with the guide groove and slides on it. Driving forces are transmitted from the shaft to the first scroll member through the eccentric portion. The first scroll member is prevented from rotating on its own axis by the engagement of the cylindrical guide and slider but not from orbiting.

10 Claims, 13 Drawing Sheets

SCROLL TYPE COMPRESSOR WITH SLIDE GUIDE FOR PREVENTING ROTATION OF THE MOVEABLE SCROLL

This is a division of application Ser. No. 07/477,463, filed Feb. 9, 1990, abandoned.

FIELD OF THE INVENTION

The present invention relates to a scroll type compressor which may be effectively used as a compressor for pressurizing a refrigerant in an automobile air-conditioning system.

BACKGROUND OF THE INVENTION

A conventional scroll type compressor has a movable scroll and a stationary scroll each of which has a round base plate provided more than one spirally shaped scroll blade. The movable scroll and the stationary scroll are engaged which one another to form a closed working chamber. The movable scroll is prevented from rotating on its own axis by anti-rotation mechanism, and a shaft having an eccentric portion makes the movable scroll orbit so that the volume of the working chamber is decreased to achieve a pumping operation.

In more detail, as shown in U.S. Pat. No. 4,650,405, the eccentric portion of the shaft is engaged with the round base plate of the movable scroll at the center portion of the round base plate and the anti-rotation mechanism is provided around the engaging portion of the eccentric portion and the round base plate. When the engaging portion mechanism, the anti-rotation mechanism does not work, the pumping operation is not achieved properly. To avoid this situation, an end portion of the driving shaft is disposed at the center portion of a housing in which the movable and stationary scroll are provided. That causes restrictions on designing and positioning of the compressor in a car, and the shaft to support the movable scroll disadvantageously becomes a cantilever. The anti-rotation mechanism affects the scroll-type compressor in its consumption power, efficiency and reliability because the orbital radius of the movable scroll depends on the anti-rotation mechanism.

The conventional anti-rotation mechanism is described in Japanese Patent Unexamined (Kokai) Publication No. 55-155916. In such anti-rotation mechanism, the housing and movable scroll have a plurality of grooves on its contacting surface, and balls or rollers are provided in the grooves.

In the anti-rotation mechanism using balls, each ball is in contact with a groove at one point and the load applied to each of balls becomes large. In order to disperse the load applied to each of the balls, it is necessary to increase the number of balls. When the number of balls increases, the diameter of the compressor increases. Because the orbital diameter of the movable scroll depends on the diameter of the groove, high precision of the groove driving production is required and the cost increases. When the production precision of the groove is low, the movable scroll and the stationary scroll come into contact with one another so that the consumption power increases and heat is generated, or the clearance between the movable scroll and the stationary scroll becomes large so that the efficiency of the compressor is decreased.

In order to orbit one of the scrolls, it is necessary to provide at least two balances which rotate while keeping a certain phase difference relative to the movable scroll. The three balances including the movable scroll keep the balance; however, these balancers disadvantageously increase the number of parts and weight of the compressor and its cost.

SUMMARY OF THE INVENTION

According to this invention, the improved scroll compressor includes a housing, a first scroll having a first base plate and a first scroll blade, a second scroll having a second base plate and a second scroll blade engaged with the first scroll blade, a shaft having an eccentric portion which is engaged with the outer portion of the first base plate and revolves the first scroll, a slide-guide having a guide groove on its end surface and being supported on the housing, and a slider slidably disposed in the guide groove.

DETAILED DESCRIPTION OF THE PREFERRED EMBODIMENT

Figure 1:
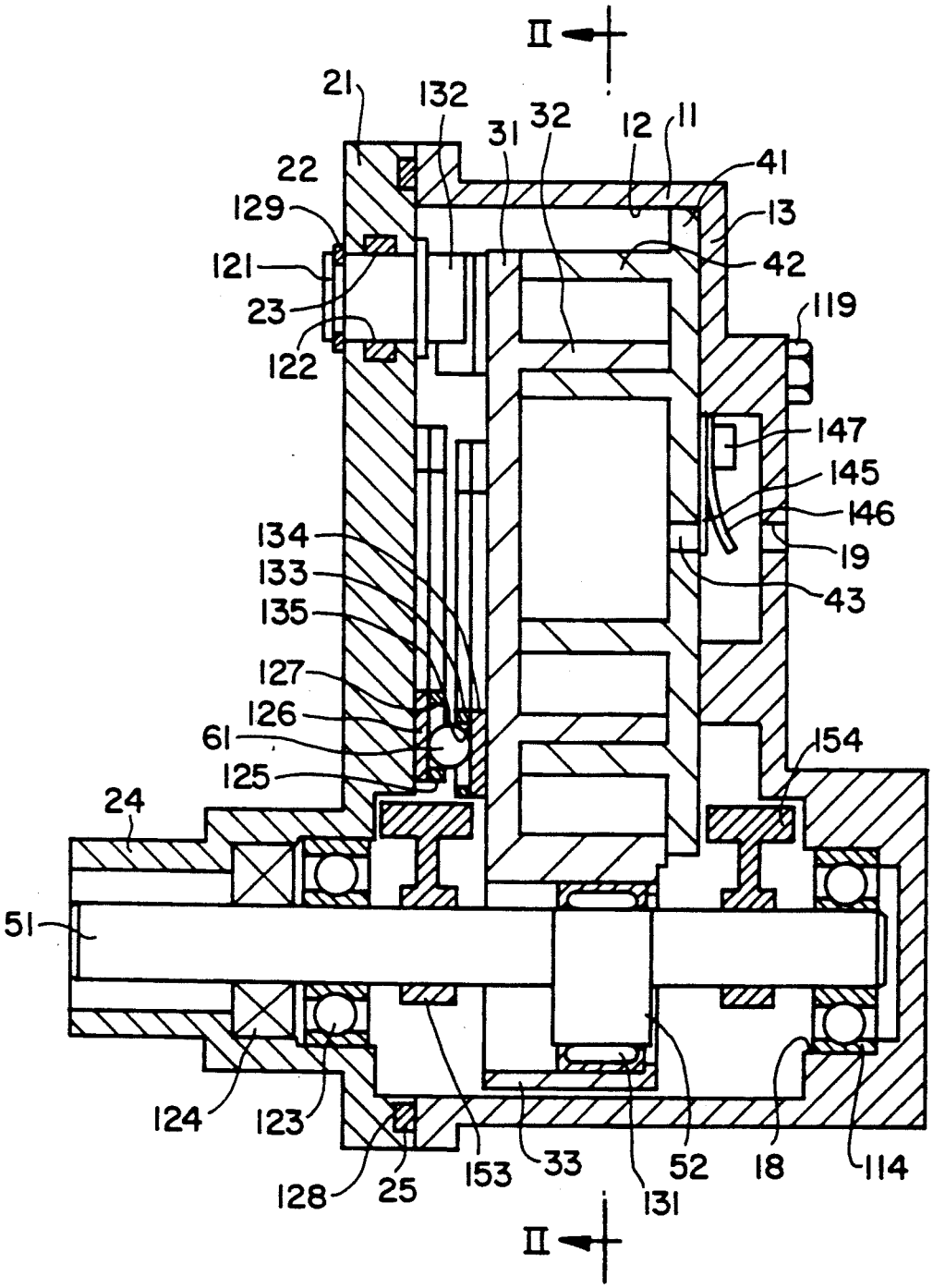
FIG. 1 is a vertical cross-sectional view of the scroll compressor according to the invention.
Figure 2:
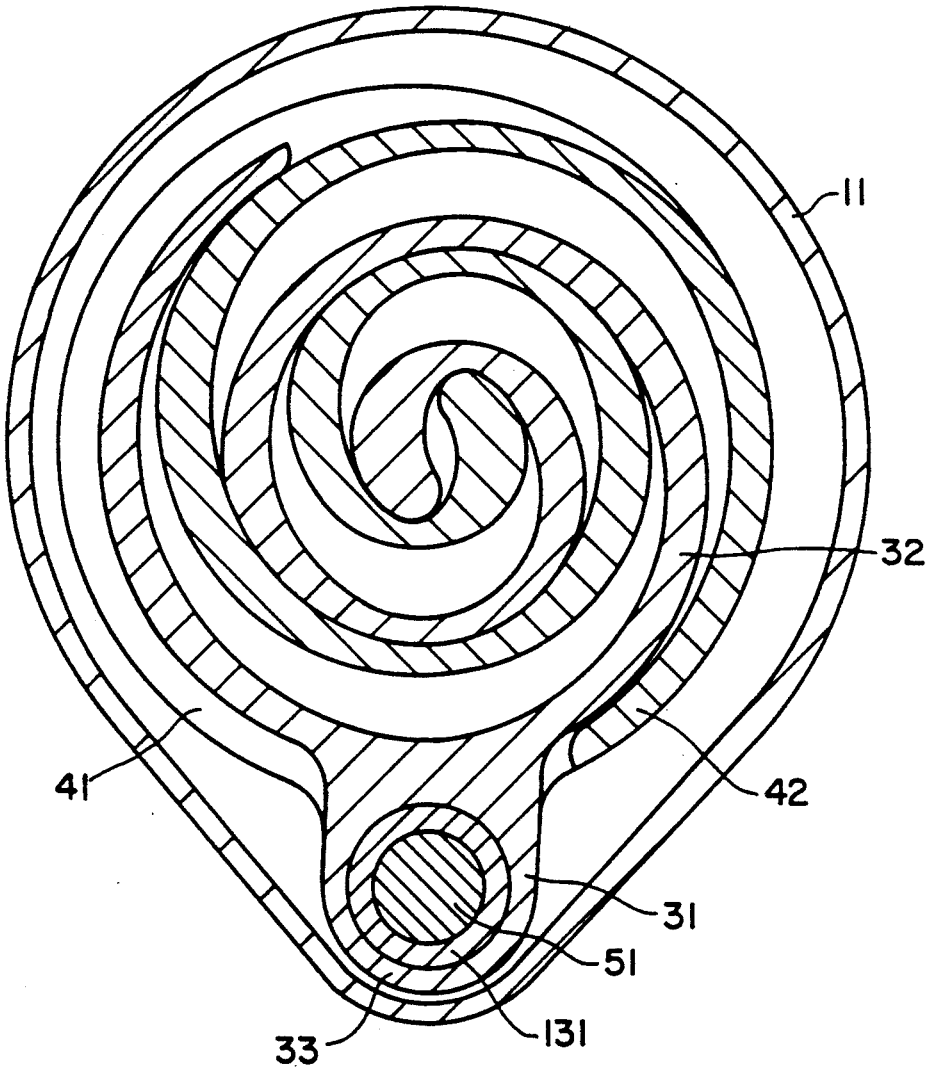
FIG. 2 is a cross-sectional view taken along the line II—II of FIG. 1.

In FIGS. 1 and 2, a housing 11 has a rear plate 13 and forms a rotor chamber 12. The rear plate 13 has a cylindrical boss 18 in which a ball bearing 114 is disposed. A suction port (not shown) and a discharge port 19 are open on the housing 11.

A front plate 21 is connected with the housing 11 by bolts (not shown). The front plate 21 has a opening 22 and a ring-shaped groove 23 in which an O-shaped ring is disposed. A cylindrical slider guide 121 is held in opening 22 rotatably by a circlip 129. The front plate 21 has a boss portion 24 in which a ball bearing 123 and a seal member 124 are disposed. A ring-shaped race frame 125 having a round-shaped groove 127 and a thrust plate 126 are fixed on the surface of the front plate 21 confronting the housing 11. A ring-shaped groove 25 is formed on the surface of the front plate 21 which is in contact with the housing 11, and an O-shaped ring 128 is disposed in the ring-shaped groove 25.

Figure 11A:
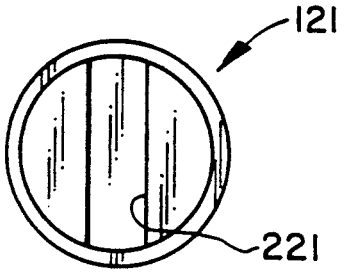
FIGS. 11(*a*), 11(*b*) and 11(*c*) are respectively a front view, a side view and a perspective view of the slide guide.
Figure 11B:
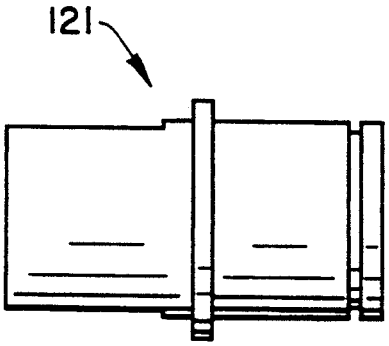
Figure 11C:
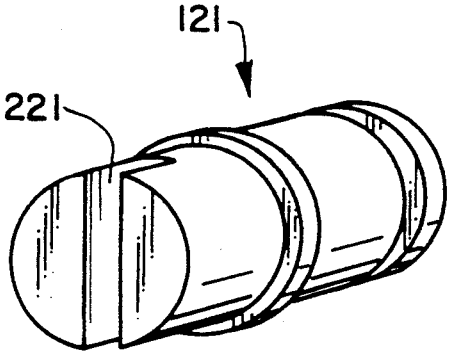
Figure 12:
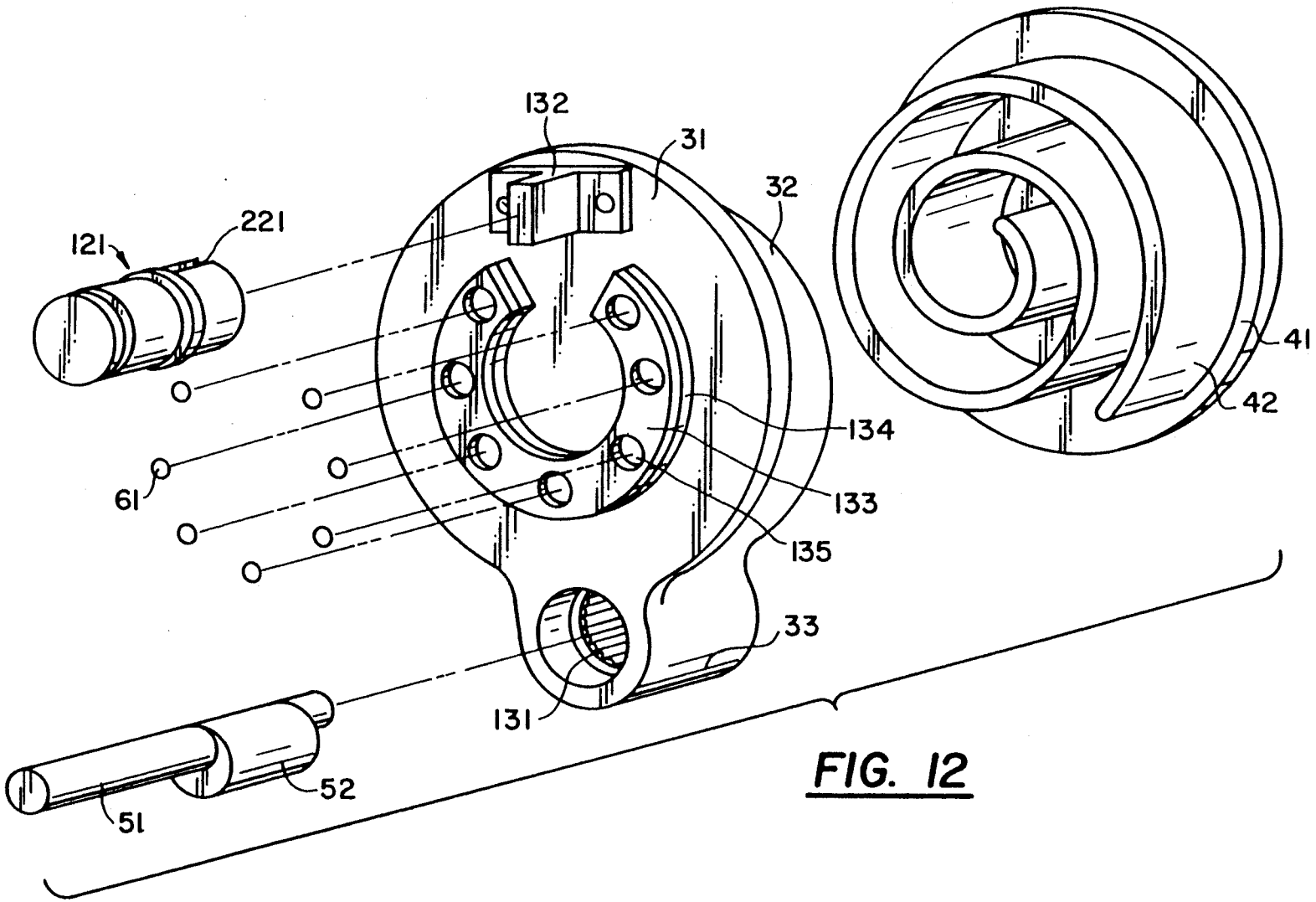
FIG. 12 is a schematic exploded view of the first embodiment, and FIGS. 13(*a*) through 13(*d*) are schematic views showing the motion of the first scroll.
Figure 13A:
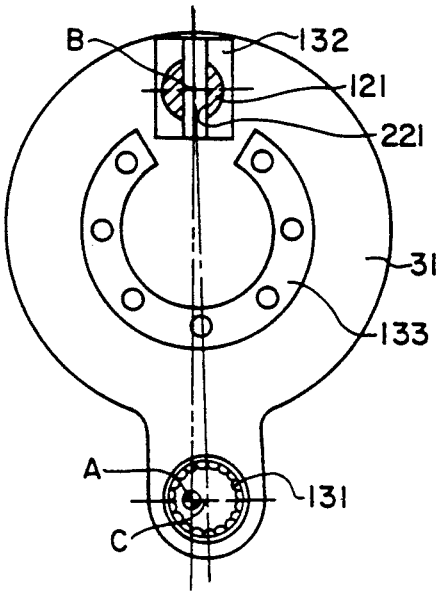
Figure 13B:
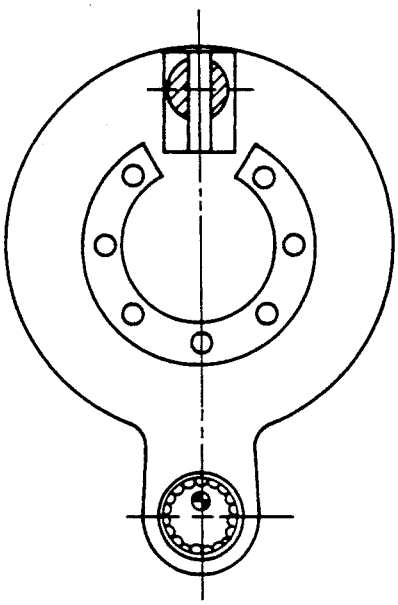
Figure 13D:
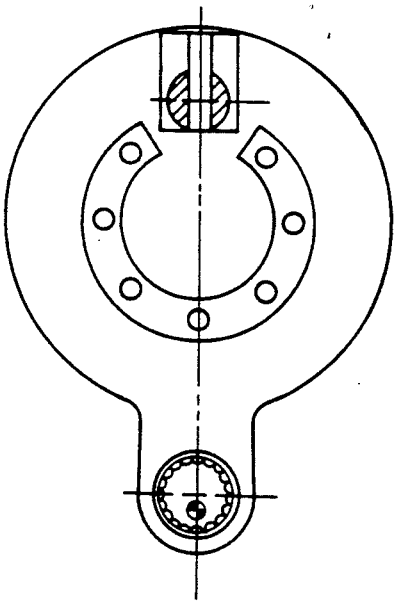
Figure 13C:
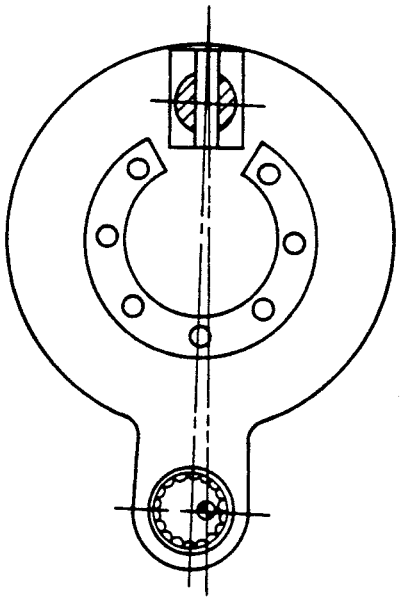

A first scroll 31 has a first scroll blade 32 at its side surface and a boss portion 33 in which a bearing 131 is provided. A slider 132, a ring-shaped race frame 133 having a ring-shaped groove 135 and a thrust plate 134 are fixed on the other side surface of a first scroll 31. The slide guide 121 rotatably held in the opening 22 has a guide groove 221 which is the shape of a slit as shown in FIG. 11. In FIG. 12, the slider 132 is fixed by bolts to the first scroll 31 on the face opposite to the face having the blade 32. The end of the slider 132 is inserted slidably into the groove 221. The purpose of the slider 132 and the slide guide 121 is to prevent the first scroll 31 from relative rotation and to move the first scroll 31 almost vertically at the engaging portion. The ring-shaped race frame 133 and the thrust plate 134, each having the shape of a horse shoe type concentric circle, are disposed at the center of the first scroll 31. The ring-shape race frame 133 has a plurality of round-shaped grooves 135 therein. The same round-shaped grooves 127 and thrust plate 126 are disposed on the front plate 21. The ring-shaped race frame 133 and the same race frame 125 confront each other through the plurality of balls 61 which are respectively disposed in confronting pairs of round-shaped grooves 127 and 135.

The plurality of balls 61 are movably held between the round-shaped grooves 135 and 127 so as not to come out. The balls 61 receive the thrust load which arises by the pressure of the converged fluid and are available to aid the smooth orbital motion of the first scroll 31.

A second scroll 41 has a second scroll blade 42 engaged with the first scroll blade 32 on its side surface. The cross sectional view in FIG. 2 shows the state wherein two scroll blades 32 and 42 are engaging. A discharge port 43 is located at around the center of the second scroll blade 32. A discharge valve 145 and valve stopper 146 are fixed by a bolt 147 on the outer side surface of the second scroll 41.

Crank shaft 51 has an eccentric portion 52 which is eccentric from the axis of the shaft 51 a certain amount. The crank shaft 51, the first scroll 31 and the second scroll 41 are all disposed in a space which is formed by the housing 11 and the front plate 21. The second scroll 41 is connected with the housing 11 by bolts 119. The first scroll 31 is disposed in the housing 11 in such a manner that the first scroll blade 32 is engaged with the second scroll blade 42 and is supported by the eccentric portion 52 of the crank shaft 51 via the bearing 131. A balancer 153 and a balancer 154 are fixed on the crank shaft 51 in front and behind of the eccentric portion 52 in such a manner that the eccentric weights of the balancers 153 and 154 are positioned on opposite sides of the weight of the eccentric portion 52. Crank shaft 51 is supported on the rear plate 13 and the front plate 21 by a ball bearings 114 and 123.

The operation of the scroll compressor is described below. When the crank shaft 51 is rotated by an outer driving force, the eccentric portion 52 executes the eccentric rotary motion, so that the first scroll 31 supported by the eccentric portion 52 through the bearing 131 executes the eccentric motion.

While the slider 132 is slidably inserted into the slide guide 121, the rotary motion is restricted at the engaging portion between the slider 132 and the slide guide 121, so that the slider 132, i.e., the first scroll 31 executes almost a linear motion.

This prevents the first scroll 31 from turning its own axis, and the first scroll 31 executes almost an orbital motion.

Figure 4:
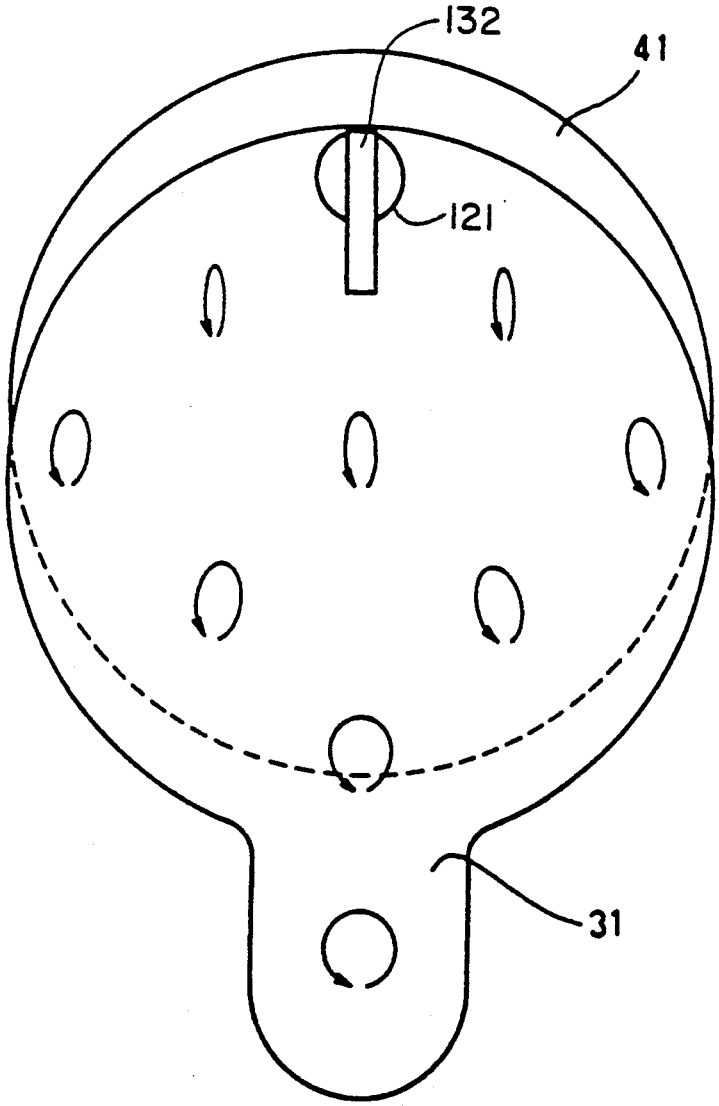
FIG. 4 is a schematic view of the first scroll and the second scroll for explaining the movement of the first and second scrolls.

FIGS. 13 (*a*)–13(*d*) explain the motion of the first scroll 31. The points A, B and C show the center of the crank shaft 51, the center of the slide guide 121 and the center of the eccentric portion 52, respectively. Accordingly, as the rotation of the crank shaft 51 advances as from FIG. 13(*a*) to FIG. 13(*b*) etc. back to FIG. 13(*a*), the center C of the eccentric portion 52 executes orbitally around the point A. On the other hand, the slider guide 121 is rotatably supported by the front plate 21 so that the convex portion of the slide guide 132 always goes through the point B which is the center of the slide guide 121, i.e., at the point B the rotary motion of the first scroll 32 is restricted so that linear motion in the upward and downward direction in FIG. 13 is executed. The movement of the various points in the first scroll 31 is shown in FIG. 4, The first scroll 31 is shown at the bottom position of the slide-crank motion, which corresponds to the position of FIG. 13(*b*). The solid line ellipses in FIG. 4 show respective loci of various points on the first scroll 31 when the first scroll 31 orbits counterclockwise. The movable first scroll 31 gets in a slide-crank orbital motion against the stationary second scroll 41 and operates pumping operations. Unbalanced forces generated by the slide-crank orbital motion of the first scroll 31 are cancelled by the balancers 153 and 154. According to the present embodiment, the crank shaft 51 can be positioned at an outer portion of the housing 11, so that the possible ranges for designing and positioning of the scroll compressor are increased. The crank shaft 51 can be supported on both of its ends without increasing the number of spirals of the first and second scroll blades 32, 42, so that reliability of the scroll compressor is increased. Furthermore, precise production processing of the anti-rotation mechanism is not needed, and hence reliability is increased and the cost is decreased.

The shapes of the first and second scrolls are explained hereinafter with reference to FIG. 1 and FIG. 2. Blade 32 of the first scroll 31 is shaped as involute, and the profile of the first and the second scroll blades 32, 42 is formed in such a manner that the sealing point of the first and the second scroll blades 32, 42 moves from the outer side into inner side of the scroll blades 32, 42 and the refrigerant in the working chamber is compressed and discharged through the discharge port 43. The profiles of the first blade 32 and second blade 42 are similar so that their thicknesses are substantially equal at corresponding points along their lengths. In FIG. 2, the thickness of both blades 32, 42 at their right side and left side portions is larger than their other portions, as is required for proper slide-crank orbital motion of the first scroll 31.

In slide-crank motion arrangements, as the distance between the boss 33 and the opposite end of the scroll becomes longer, the orbital motion moves towards a perfect circle. However, increasing that distance to obtain a preferred circular orbit causes the body of the scroll compressor to become too large. Hence, the present embodiments are employed.

FIG. 6 shows the process of compressing at every crank shaft angle of $\pi/2$ radians (90°) in the scroll compressor. The point B is a fulcrum of the first scroll 31. Point C which is eccentric against the center point A of the shaft 51 rotates around the point A. That is the first scroll 31 makes the slide-crank orbital motion. The refrigerant is moved into the center portion upon being compressed as shown in FIG. 6(*a*) through FIG. 6(*d*).

Figure 3:
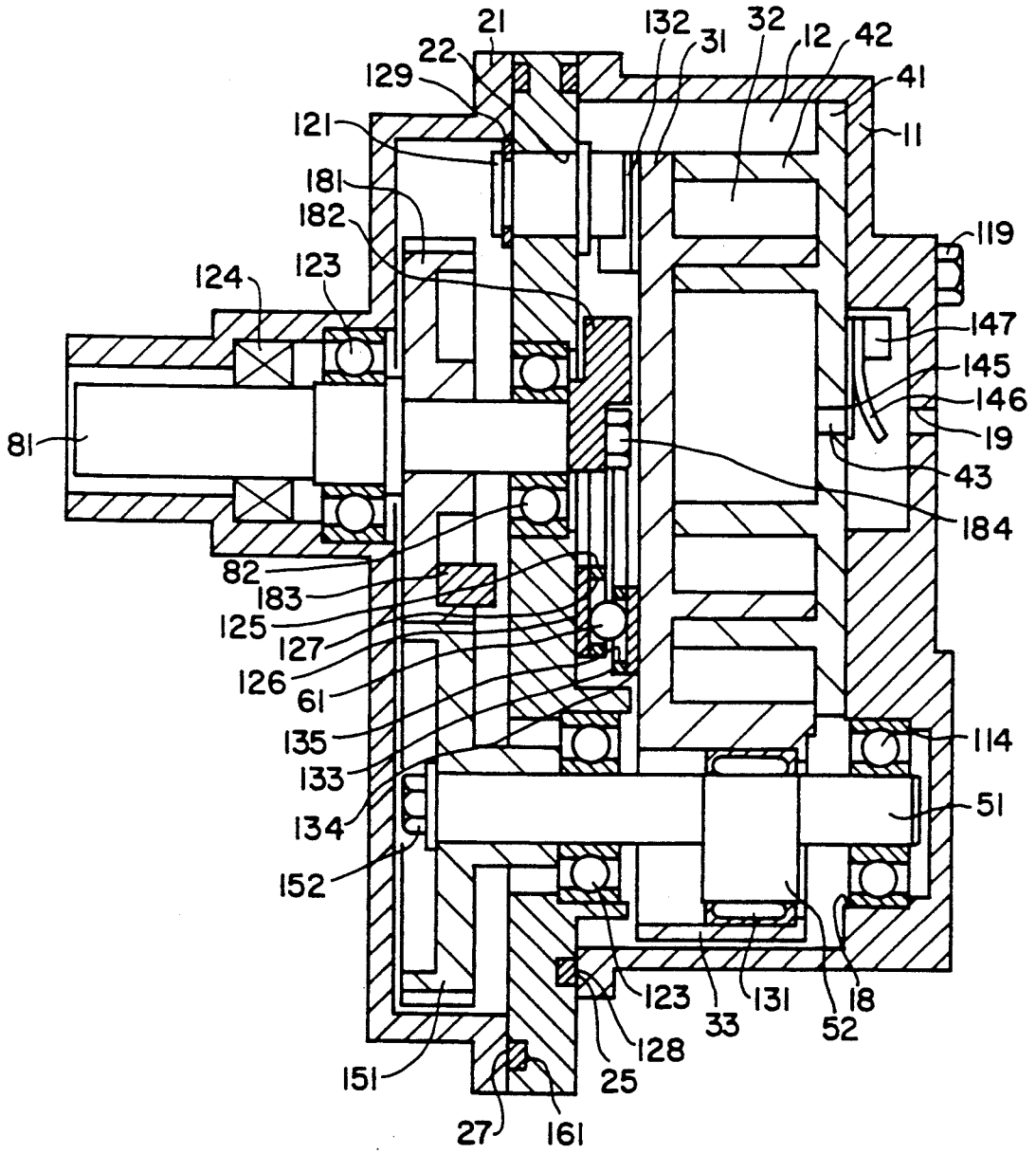
FIG. 3 is a vertical cross-sectional view of the second embodiment of the scroll compressor.

The second embodiment of the present invention is described with reference to FIG. 3. The same parts as the first embodiment have the same numerals and their explanation is therefore omitted.

A first gear 181 fixed on a driving shaft 81 and a second gear 151 fixed on a crank shaft 51 by a bolt 152 have the same number of teeth, so that the driving shaft 81 and the crank shaft 51 rotate at the same rotational frequency. A balancer 182 is fixed at the end of the driving shaft 81 by a bolt 184. The first gear 181 has a balancer 183. The eccentric directions of the balancer 182 and the eccentric portion 52 are opposite, and the eccentric directions of the balancer 183 and the eccentric portion 52 are the same. The present embodiment reduces the frontal and radial cross-sectional areas besides having the benefits produced by the first embodiment. Additionally, the use of gears allows shaft 81 to be located during manufacture at any place along an arc extending from side to side of the compressor, thereby providing more flexibility in location of the compressor in the engine room of a car.

Figure 5:
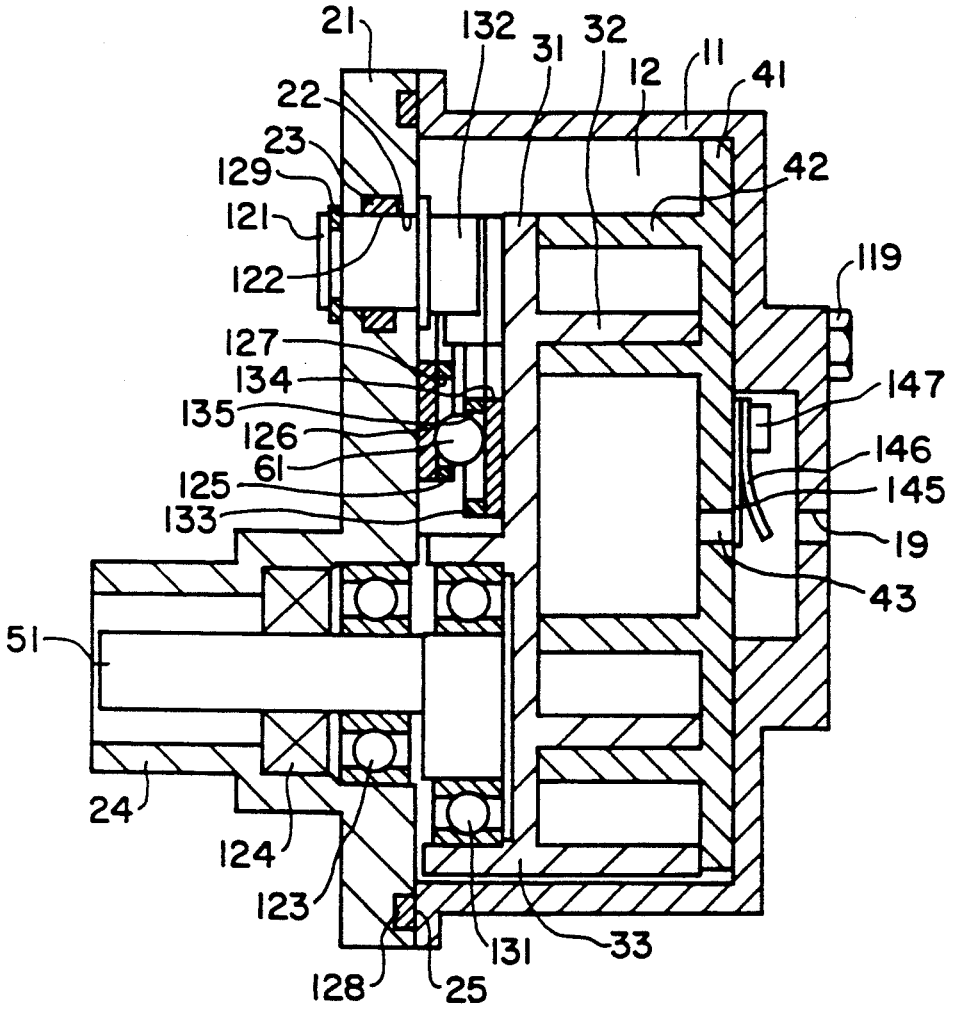
FIG. 5 is a vertical cross-sectional view of the third embodiment of the scroll compressor, FIG. 6(*a*) through FIG. 6(*d*) are schematic views showing the process of compressing the refrigerant at each $\pi/2$ radians of the shaft.
Figure 6A:
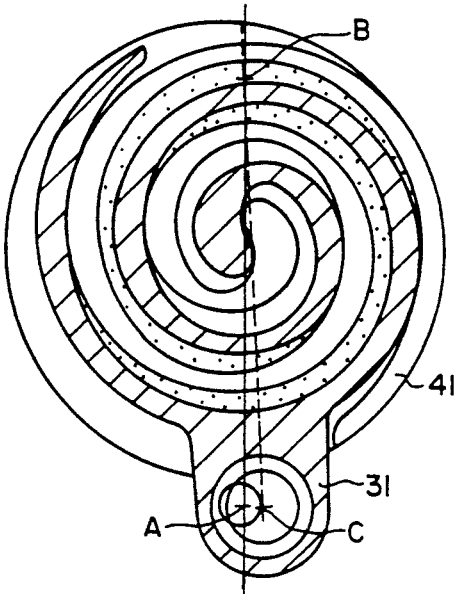
Figure 6B:
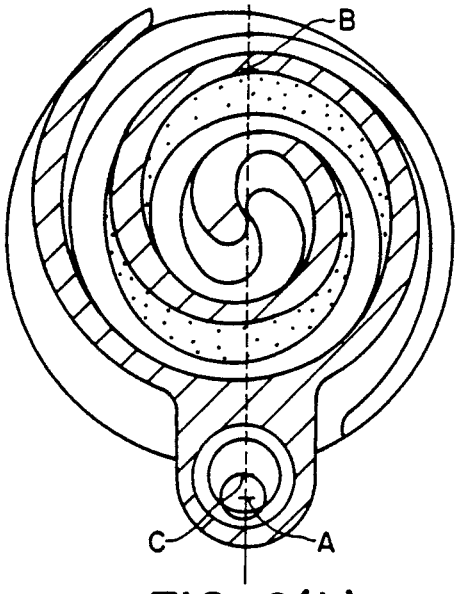
Figure 6D:
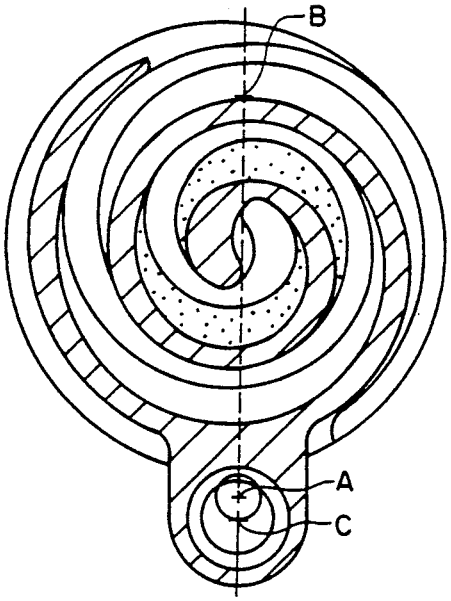
Figure 6C:
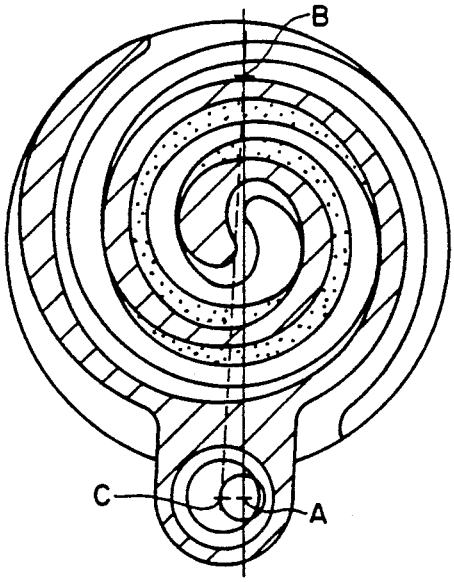

The third embodiment of the present invention is described with reference to FIG. 5. The crank shaft 51 is a cantilever supported by a ball bearing 123 and does not penetrate through the first scroll 31. The first scroll 31 is given an eccentric motion through the crank shaft 51 and is put in slide-crank orbital motion against the second scroll 41.

Since the crank shaft 51 of the present embodiment is a cantilever and does not penetrate through the first scroll 31, the number of bearing parts and occupied space are decreased.

The fourth embodiment of the present invention is described with reference to FIG. 7. The housing 11 has a rear plate 13. A cylindrical projected portion 15 having a ring-shaped groove 14 for receiving a tip sealing member 111 is provided on the rear plate 13. An opening 16 on the rear plate 13 receives a slider guide 112 rotatably and has a ring-shaped groove 113 to receive an O-shaped ring 17. The rear plate 13 has a boss portion 18 in which a ball bearing 114 is disposed. A ring-shaped race frame 115 including a thrust plate 116 are provided around the cylindrical projected portion 15. The second scroll 41 has a boss portion 44 in which a bearing 141 is disposed. A slider 142, a race frame 143 including a thrust plate 144 are fixed on the side surface of the second scroll 41.

A crank shaft 51 has a first eccentric portion 52 and a second eccentric portion 53 which has the same weight as the first eccentric portion 52 and faces to the opposite eccentric direction against the first eccentric portion 52. The first scroll 31 is supported on the first eccentric portion 52 through a bearing 131, and the second scroll 41 is supported on the second eccentric portion 53 through a bearing 141.

The first scroll 31 and the second scroll 41 make eccentric motions with a $\pi$ radian (180°) phase difference. Since the slider 132 is engaged with the slider guide 121 and the slider 142 is engaged with the slider guide 112, these engaging portions of the first and the second scroll 31, 41 can move only vertically in FIG. 7 and are prevented from rotating. The motions of the first and second scrolls 31, 41 are called slide-crank orbital motion.

In the present embodiment, the sliders 132 and 142 which are in sliding motion are positioned at opposite sides of the bearings 131, 141 against the center of the scroll teeth 32,42.

Eccentric forces arise on each of the first scroll 31 and second scroll 41. However, since the first scroll 31 and second scroll 41 have a $\pi$ radian phase difference to one another in their slide-crank motion, the eccentric forces cancel one another. Furthermore, since the distance between the centers of gravity of the first scroll 31 and second scroll 41 is small, the first and the second scrolls 31, 41 can orbit smoothly and silently up to a high number of rotations without the need of balancing means.

The fifth embodiment of the present invention is described with reference to FIG. 8. A ball bearing 82 is disposed in an opening 26 at the center of the front plate 26. A groove 27 is formed on one side of the front plate 21 to receive an O-shaped ring 161. A second gear 151 is fixed at the end of the crank shaft 51 by a bolt 151. A front cover 71 has a boss portion 72 in which a ball bearing 171 and a sealing member 172 are disposed. A first gear 181 is fixed at the end of the driving shaft 81. The front cover 71 is connected to the housing 11 and the front plate 21 by bolts (not shown). The driving shaft 81 is supported rotatably by the ball bearing 82. A first gear 181 and second gear 151 are engaged with one another.

The driving power is transmitted from the driving shaft 81 to the crank shaft 51 through the first gear 181 and the second gear 151. If the ratio of the number of the teeth of the first gear 181 to the number of the teeth of the second gear 151 is 2:1, the number of rotations of the crank shaft 51 is twice as much as that of a compressor which does not have the drive shaft 81 as does the compressor in FIG. 7. That is, the discharge volume of the compressor is twice as much as that of a conventional compressor, and that is obtained without enlarging the frontal and radial cross-sectional areas of the scrolls to get twice as large a volume of the chamber formed between the two scrolls. When a certain discharge volume is required, by adopting the compressor structure in FIG. 8 the frontal and radial cross-sectional areas of the scroll can be reduced as compared to a conventional compressor. Since the ratio of the number of teeth of the first gear to the number of teeth of the second gear is 2:1, the number of rotations of the crank shaft 51 is more than that of the driving shaft 81. Therefore, the discharge volume of the compressor is doubled without expanding radially. The diameters of the first and the second gears are determined in such a manner that the axis of the driving shaft 81 is aligned with the center of the circular portion of scroll 31, i.e., disregarding boss portion 33. When the driving power is applied to the shaft by a pulley or a magnetic clutch and its axis is coincident with the axis of the part which has the largest diameter in the compressor, e.g., scroll 31, the frontal area of the compressor and drive becomes smaller than that of the embodiment in FIG. 7 wherein the drive pulley or clutch would normally project beyond the housing. Hence, for the FIG. 8 embodiment the mounting space can be utilized effectively.

Figure 7:
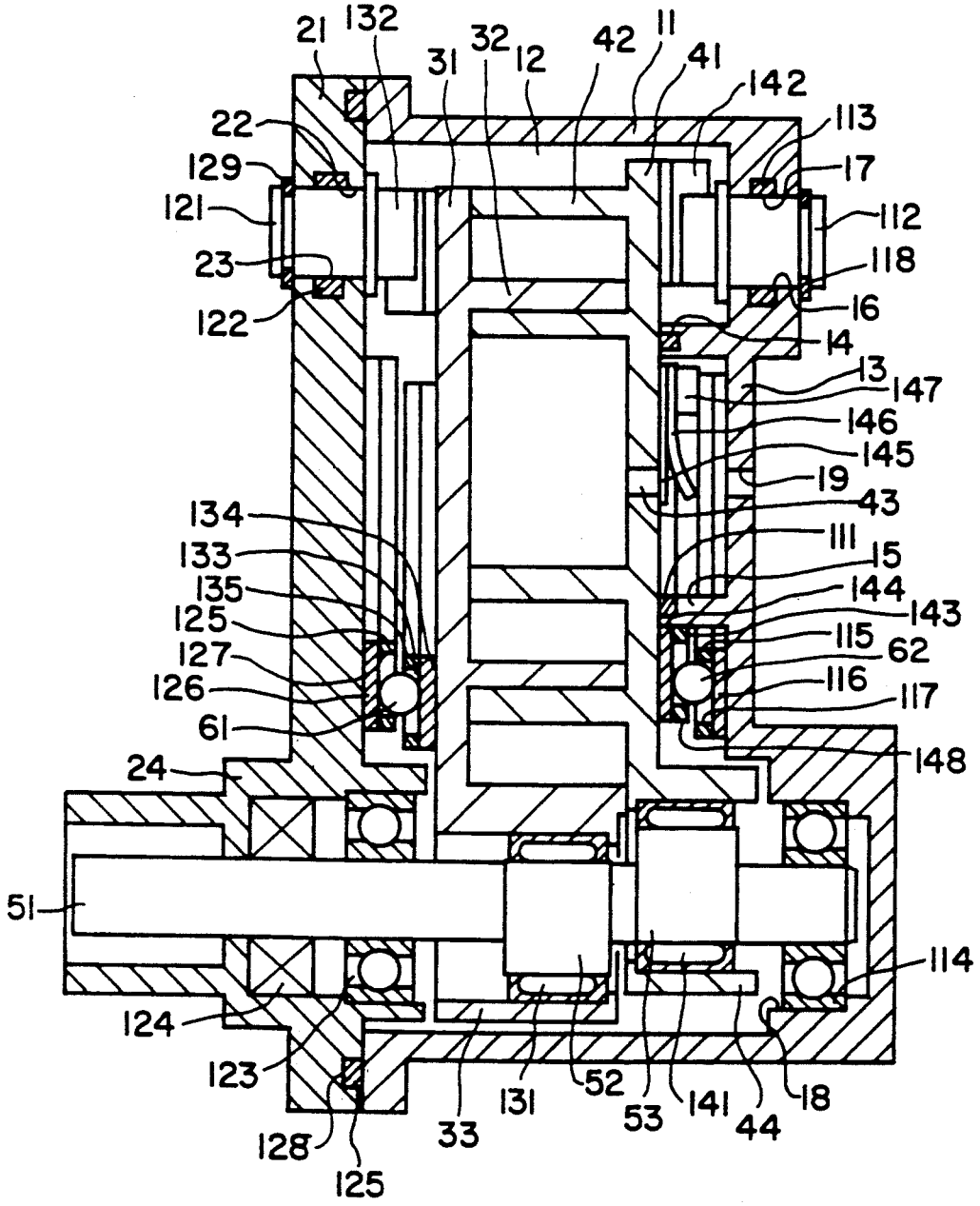
FIG. 7 is a vertical cross-sectional view of the fourth embodiment of the scroll compressor.
Figure 8:
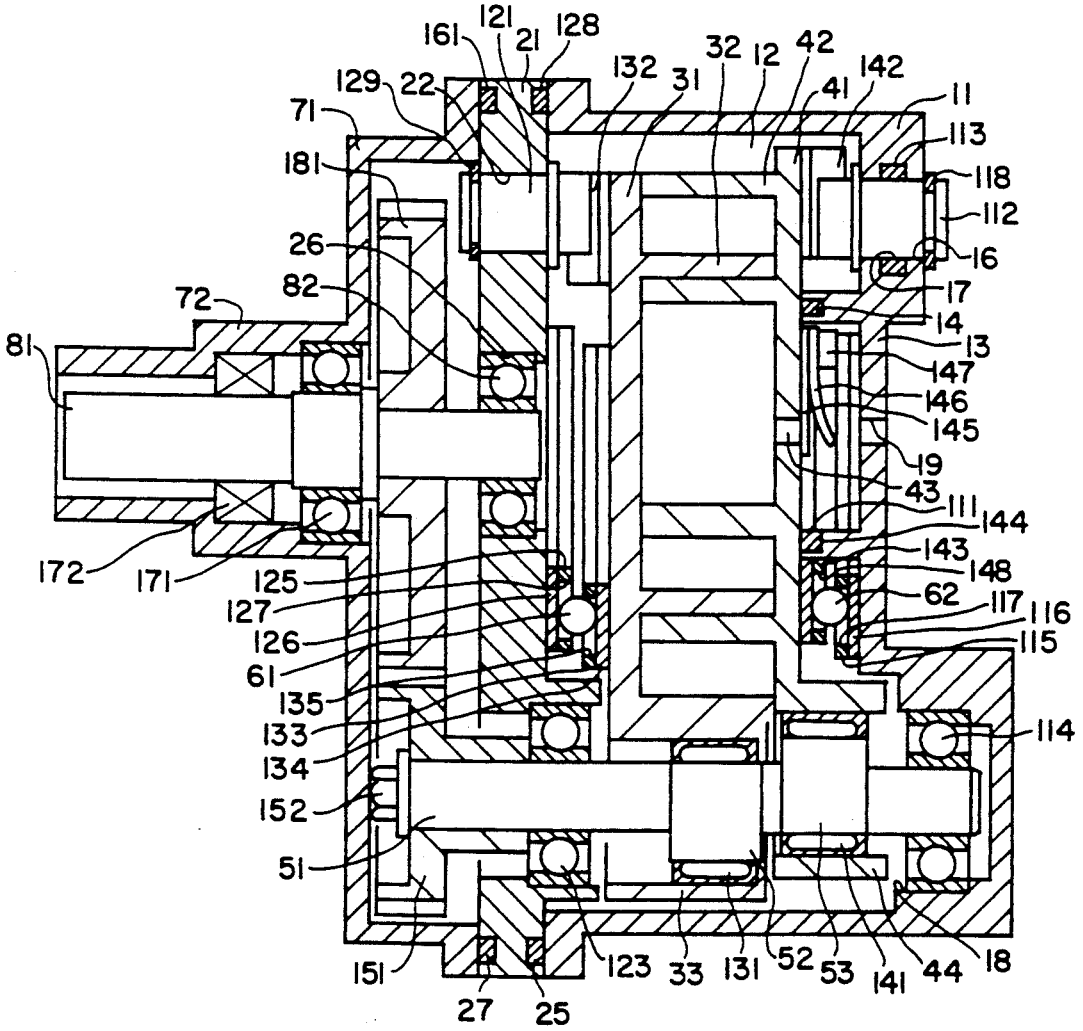
FIG. 8 is a vertical cross-sectional view of the fifth embodiment of the scroll compressor.
Figure 9:
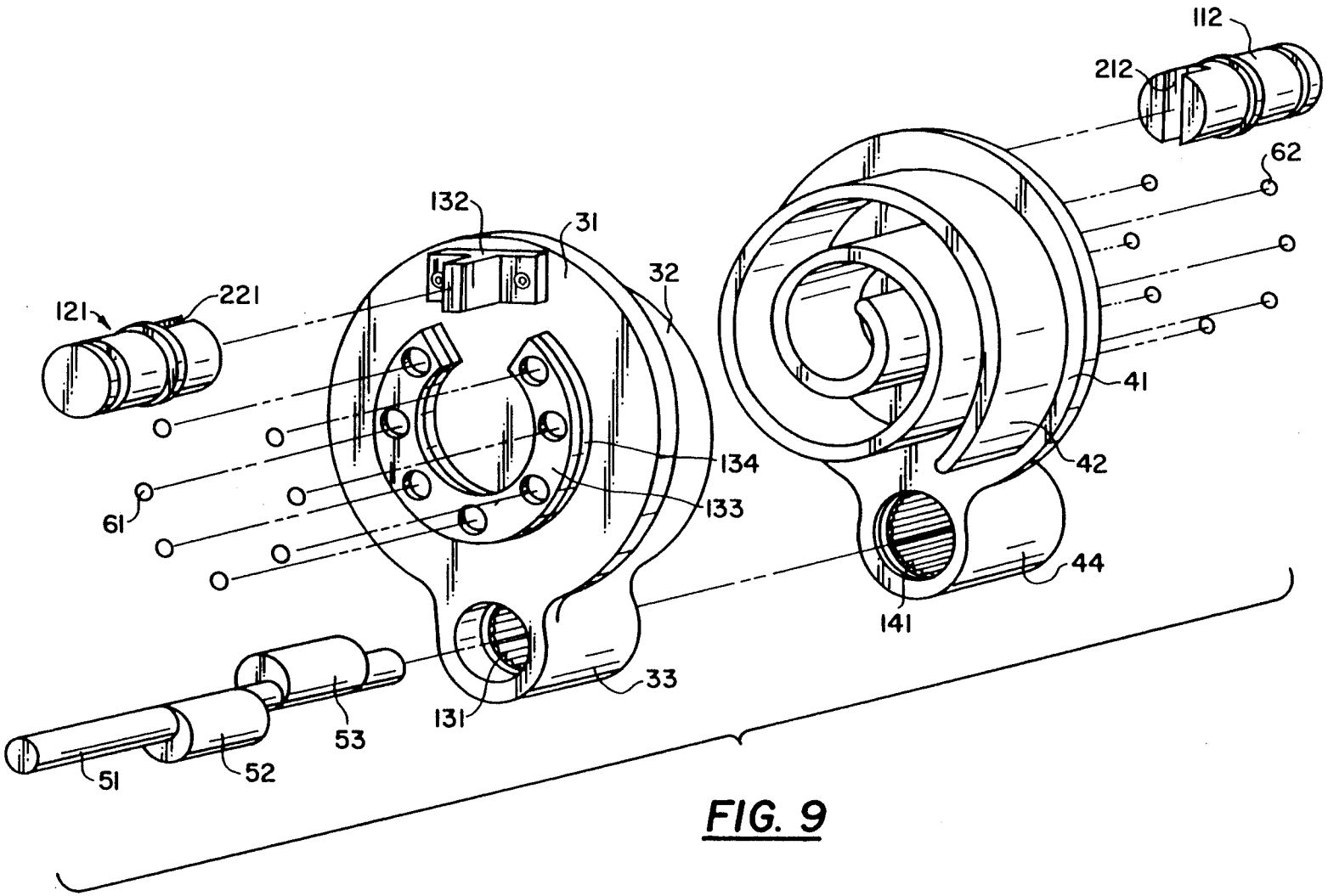
FIG. 9 is a schematic view showing the first scroll, the second scroll, the slide guide, the shaft the balls.
Figure 10:
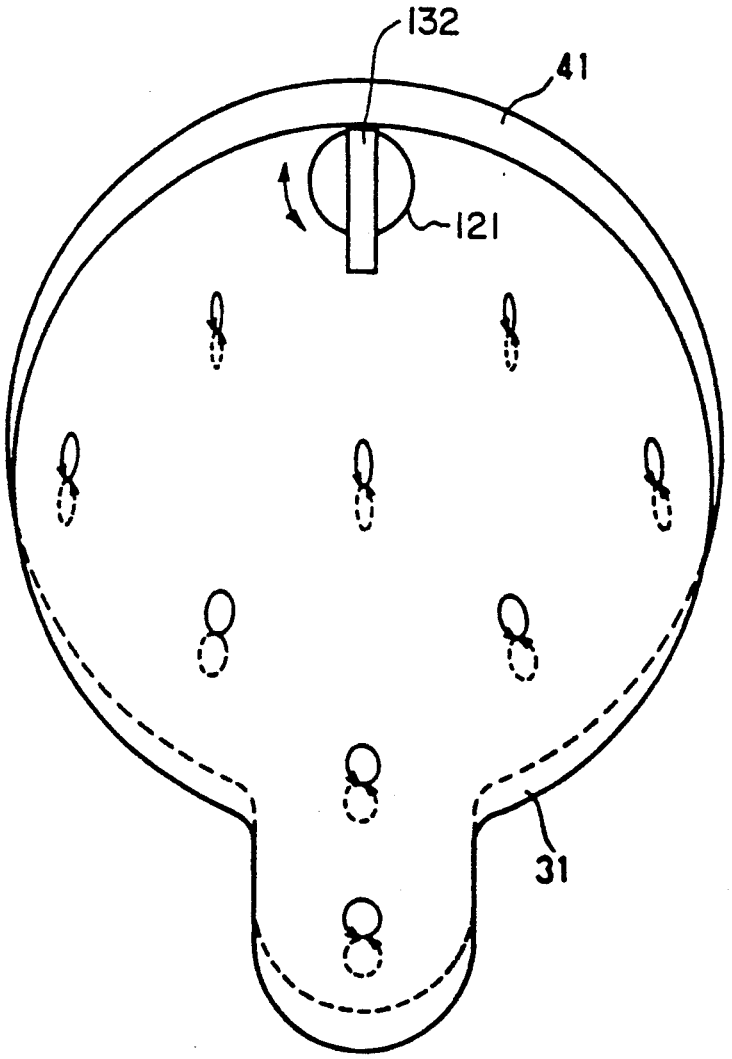
FIG. 10 is a schematic view of the first and second scrolls for explaining their relative movements in FIGS. 7 and 8.

For the FIG. 7 and 8 embodiments, FIG. 10 shows the elliptical orbital motions of scroll 31 in solid lines and of scroll 41 in dash lines.

The compressor of the present invention has as much compression, suction and discharge as the conventional compressor besides the effects described above.

According to the present invention, the crank shaft can be located a position far from the center of the movable scroll, and the ranges of possibilities for discharging and mounting the compressor are expanded. Furthermore, prior need for precise production of the anti-rotational mechanism is eliminated.

It will be appreciated that modifications may be made in this invention. Accordingly, it should be understood that all modifications falling within the true spirit and scope of this invention are covered by the appended claims.

What is claimed is:

1. A scroll type compressor comprising first and second scroll members forming a fluid working chamber, and means for moving said scroll members in a controlled elliptical orbit.

2. A scroll type compressor as in claim 1 including means for moving one scroll member in a controlled elliptical orbit 180° out of phase with the other elliptical orbit in the same orbital direction.

3. A scroll type compressor comprising:

first and second scroll members forming a fluid working chamber, means for eccentrically driving said first and second scroll members at one portion thereof, and means at a different portion of said first and second scroll members for allowing pivoting and sliding motions at said different portion while said first and second scroll members are driven.

4. A scroll type compressor comprising:

a housing forming an outer periphery of the compressor;

a first scroll member disposed in the housing and having a first base plate and a first scroll blade provided on a side surface of the first base plate;

a second scroll member disposed in the housing and having a second base plate and a second scroll blade, the second scroll blade being provided on a side surface of the second base plate and being engaged with the first scroll blade;

a shaft supported on the housing, having first and second eccentric portions and rotating upon receiving driving power, said first and second scroll members being supported on and driven by the two eccentric portions, respectively; and means for preventing relative rotation between said first scroll member, and said second scroll member, said preventing means including a plurality of slide guides supported rotatably at one end of each guide and having a guide groove on the other end respectively, and a plurality of slides slidably engaged with said guide grooves.

5. A scroll type compressor comprising:

a housing forming an outer periphery of the compressor;

a first scroll member disposed in the housing and having a first base plate and a first scroll blade provided on a side surface of the first base plate;

a second scroll member disposed in the housing and having a second base plate and a second scroll blade, the second scroll blade being provided on a side surface of the second base plate and being engaged with the first scroll blade;

a shaft supported on the housing, having first and second eccentric portions and rotating upon receiving driving power, the first and second scroll members being supported on and driven by the two eccentric portions, respectively;

a plurality of guides supported rotatably on the housing at one end of each guide and having a guide groove on the other end respectively; and a plurality of sliders fixed on the scroll members driven by the shaft and slidably engaged with the guide grooves.

6. A scroll type compressor according to claim 5, wherein the shaft and the guides are diametrically opposed.

7. A scroll type compressor according to claim 6, wherein the shaft is below the center of the compressor and the guides are above the center of the compressor.

8. A scroll type compressor according to claim 5, wherein the first and second scroll members are supported on said eccentric portions through bearings.

9. A scroll type compressor according to claim 5, wherein the shaft is supported on the housing at both ends by bearings.

10. A scroll type compressor according to claim 5, wherein the shaft comprises a driving shaft and a crank shaft, a first gear is connected to the driving shaft, a second gear is connected to the crank shaft, and the first and second gears are engaged with each other to transmit driving forces from the driving shaft to the crank shaft.

* * * * *